United States Patent [19]

Gaines et al.

[11] Patent Number: 4,737,154

[45] Date of Patent: Apr. 12, 1988

[54] CHEMICAL PROCESS FOR THE COLORATION OF WOOD IN A BASIC AQUEOUS MEDIUM

[75] Inventors: Jack R. Gaines; Robert L. Sandvig, both of Rapid City, S. Dak.

[73] Assignee: SDSM&T Foundation Research Center, Inc., Rapid City, S. Dak.

[21] Appl. No.: 77,011

[22] Filed: Jul. 21, 1987

Related U.S. Application Data

[63] Continuation of Ser. No. 805,837, Dec. 6, 1985, abandoned.

[51] Int. Cl.[4] ..... D06P 5/00

[52] U.S. Cl. ..... 8/402; 427/440

[58] Field of Search ..... 8/402; 427/440

[56] References Cited

U.S. PATENT DOCUMENTS

| | | | |
|---|---|---|---|
| 2,042,825 | 6/1936 | Bright | 8/402 |
| 2,210,832 | 8/1940 | Bright | 8/402 |
| 2,802,712 | 8/1957 | Weber | 8/6.5 |
| 2,867,543 | 1/1959 | Braun, Jr. | 117/46 |
| 3,685,959 | 8/1972 | Dunn, Jr. | 21/7 |
| 3,877,976 | 4/1975 | Olson et al. | 427/317 |
| 3,969,454 | 7/1976 | Thornber et al. | 264/78 |
| 4,044,172 | 8/1977 | Bugg | 427/55 |
| 4,313,976 | 2/1982 | Leach | 427/297 |
| 4,322,211 | 3/1982 | Hoyle et al. | 8/402 |
| 4,430,240 | 2/1984 | Sandvig et al. | 252/70 |

FOREIGN PATENT DOCUMENTS

| | | | |
|---|---|---|---|
| 8402434 | 8/1984 | Brazil . | |
| 46-00834 | 9/1971 | Japan | 8/402 |

*Primary Examiner*—Paul Lieberman
*Assistant Examiner*—John F. McNally
*Attorney, Agent, or Firm*—Merchant, Gould, Smith, Edell, Welter, & Schmidt

[57] ABSTRACT

An attractive, decorative naturally-appearing stained color can be given to wooden members by contacting the wood with a basic aqueous medium at elevated temperatures.

25 Claims, No Drawings

CHEMICAL PROCESS FOR THE COLORATION OF WOOD IN A BASIC AQUEOUS MEDIUM

This is a continuation of application Ser. No. 805,837, filed Dec. 6, 1985, now abandoned.

FIELD OF THE INVENTION

The invention relates to a chemical treatment process for producing in a wooden member an attractive, decorative, natural-appearing color. The wood members are typically used in furniture, structural and decorative wood working, cabinets, picture frames, and other wooden constructions wherein the attractive natural-appearing color emphasizes the beauty or natural grain of the wood.

BACKGROUND OF THE INVENTION

Wooden members have been stained or painted for many years to emphasize the natural grain of wood or to produce a pleasing, attractive, decorative color in the wood.

The invention relates to a chemical process that develops an attractive colored appearance that emphasizes the natural beauty of the wood. The invention does not relate to opaque coatings such as paints. Commonly available stain compositions typically comprise a solution or dispersion of a colorant or dye in a vehicle designed primarily to be applied to a surface of a wood article to impart color rather than to form a protective coating. Stains are typically different than paints and other coatings since stains are decorative and do not form opaque coatings. The colorant or dye in the stain composition, when contacted with a wooden surface, typically associates either physically or chemically with the wood surface. The coloring effect results from absorption, mechanical admixture, entrapment, or dipolar attraction of the colorant and the cellulosic wood constituents. Often reactions between the dye and the binder can occur in combination with the cellulose or the dye and binder can be physically associated with the cellulose.

Commonly available stains are typically characterized as non-grain-raising stains, oil stains (both penetrating and non-penetrating), spirit stains and water stains. These classifications generally refer to the vehicle which forms the dispersing media for the dye or colorant. Both organic and inorganic dyes and colorants are used and include such compositions as FD&C RED #1, FD&C Blue #1, rhodamine B, methylene blue, phthalocyanine, ultramarine, iron oxides, and others.

In the application of conventional stains to wood members typically an amount of the stain composition is applied to a brush, rag or other application implement, the stain is applied to the surface of the wood member, the implement is used to insure a complete contact between the stain composition and the wood member, and the excess stain is removed using a wash or other cleaning means such as a rag or cloth. Such processes can be inconvenient since they can result in stain contacting persons applying the stain to the wood member, can be dangerous since the stain can contain toxic or other harmful dye or vehicle compositions, and can waste the stain composition since excess stain, which must be removed from the wood member, is typically discarded. Soft woods such as pine, fir, and other evergreens can be difficult to stain and obtain a pleasing and uniform appearance.

The treatment of oak with gaseous ammonia is known, however this process is limited to oak and produces a particular fumed oak appearance. Brazilian Pat. App. No. PI 8402434 teaches darkening clear hardwood for increasing the quality, refinement and appearance of the wooden product by immersing logs, sheets, boards having a thickness of at least 0.2 millimeters in a tank of water which is heated gradually from about 60° C. to 160° C. during a time period of 48 to 168 hours. Such a process is time consuming and requires equipment that will gradually raise the temperature. More importantly, we have discovered that the use of water alone does darken wood, however the final product can be seriously degraded even after a brief treatment. We find that the degradation results from the formation of low pH's, about 3–4. The color resulting from the water treatment can often be dark and unpleasing in appearance.

Accordingly, a substantial need exists in the art for a rapid chemical process that can form a decorative attractive natural-appearing color without the need of the use of colorants, dyes or vehicles. A desirable process for producing a natural-appearing color is free of dyes, involve only moderate reaction conditions and protect operating personnel and equipment from contact with undesirable dyes and solvent compositions.

BRIEF DESCRIPTION OF THE INVENTION

We have discovered that an attractive, decorative pleasing naturally colored appearance, that is superior to the appearance of a conventionally stained wood, can be obtained by contacting a wooden member with a basic aqueous medium at elevated temperatures. The base in combination with water reacts with compositions of relatively low molecular weight compared to cellulose in the wood resulting in the formation of darkened colorants in situ. Once the desired color is produced in the wood, the surface is mechanically abraded to reveal the rich attractive colored appearance.

While we do not wish to be held to a theory of action of the invention, it appears that the base catalyzes an oxidative reaction involving compositions such as hemicellulose naturally present in the wood. The relatively low molecular weight components react to form the colorant throughout the wood. The color depends on concentration of base and reaction temperature. The cellulosic portion of the wood does not appear to be substantially involved in reaction and retains its structural integrity. The process then provides a natural pleasing color with no loss in structural integrity.

DETAILED DISCUSSION OF THE INVENTION

Briefly, the invention relates to processes for the production of a decorative naturally appearing wood using a basic aqueous medium at elevated temperatures.

Basic aqueous media that can be used in aqueous solution to produce the decorative finish on wood include common aqueous bases such as the alkali and alkaline earth metal hydroxides, and basic salts such as the alkali and alkaline earth metal salts of many acids. Exemplary inorganic bases include sodium hydroxide, potassium hydroxide, calcium hydroxide, magnesium hydroxide, sodium oxide, sodium silicate ($Na_2O:SiO_2$ at a ratio of about 1:0.1 to 10), calcium oxide, sodium borate, sodium carbonate, sodium bicarbonate, trisodium phosphate, sodium acetate, sodium benzoate, etc. The base typically is sufficiently soluble in aqueous solution, i.e., the solution can contain at least 1,000 parts of the base per million parts of the solvent and is stable in aqueous solutions at pH's greater than 7.

Preferred bases include inorganic alkaline earth metal bases such as calcium phosphate, magnesium phosphate, calcium acetate, magnesium acetate, calcium hydrogen phosphate, magnesium hydrogen phosphate, etc. The most preferred alkaline earth metal bases for use in the invention in coloring wood comprise calcium oxide (CaO), calcium hydroxide ($Ca(OH)_2$), magnesium oxide (MgO), magnesium hydroxide ($Mg(OH)_2$), and mixtures thereof, for reasons of ease of use, wood color forming activity, and economy.

Virtually any wooden member can be colored using the solutions and process of the invention. Wooden members of single pieces of wood or composite wooden structures made of two or more layers or pieces of wood can be colored successfully using the process and colorants of the invention. Wood for use in furniture, household and commercial woodworking, kitchen cabinets, millwork, picture frames, drawers, windows and siding, wood for use in boats and other recreational activities, can be colored using the process of the invention. Since the process of the invention results in total coloration of the wood, the process can often be most economically used for coloring green lumber. The lumber can be processed into finished articles without fear of the substantial removal of large amounts of the colored surface since the wood can be sanded, planed, or otherwise surface treated to any depth.

The reaction of cellulosic materials with bases such as sodium hydroxide or calcium oxide is described in the literature; see for example Chesley et al, U.S. Pat. No. 2,750,414 and Nielsen, U.S. Pat. No. 4,351,669 which teaches extracting surface wax from cellulosic materials. Gancy, U.S. Pat. No. 4,377,488 teaches processes for the production of various organic acids. However, to the best of our knowledge the reaçtion of cellulosic materials with basic aqueous media has not been utilized in a method to produce an attractive natural color in wooden members.

For the purpose of optimizing the production of an attractive color that penetrates the entire depth of the wood, it has been discovered that: (a) the starting material for the process should be a wooden member of sufficient or appropriate size so that it can be used in a finished wooden product when it is fully processed and colored; (b) the use of an effective reaction promoting amount of water is required in the color forming reaction zone; (c) a basic aqueous medium, preferably an alkaline earth metal oxide or hydroxide or mixtures thereof, is used; (d) the reaction zone is sealed to produce superatmospheric pressure; (e) the reaction zone is operated at elevated temperatures, generally in excess of 140° C. for substantially less than 24 hours in order to produce the pleasing appearance; (f) the reaction is performed under conditions that the base in contact with the wood produces a pleasing natural color that totally penetrates the wood; (g) after the full coloring reaction is completed, the wood is typically removed from the reaction vessel and dried thoroughly; (h) a surface film is typically removed from the wooden member to reveal the pleasing, attractive colored wood; (i) after the surface film is removed the wood can be further contacted with preservatives, oil treatments, waxes, or other post-treatment steps for the protection of the wood from rot, insects, or other hazards.

The aqueous reactant mixture after completion of the color-forming reaction typically contains salt of acetic acid, formic acid, glycolic acid and lactic acid and traces of other organic acids which appear to be formed in an oxidative reaction. Further, it appears that most of the inorganic base is converted to a carbonate by-product.

INITIATING THE REACTION

The wooden material to be treated is commonly placed in a basic aqueous media. Typically sufficient liquid is placed in the reaction chamber to completely immerse the wooden member and make contact between all sides of the wooden member and the aqueous solution. Typically the reaction mixture will contain at least 1% by weight of the basic treating agent, and preferably contains 2 to 25 wt-% of the treating agent in the aqueous solution. The temperature of the system can be raised to an effective reaction-initiating temperature which is typically about 120°-150° C. After the reaction has been initiated the temperature can be allowed to rise but should not exceed 180° C.

CONDUCTING THE REACTION

The reaction time (following the initiation of the reaction) in the batch mode can range from about 10 minutes to 6 hours, preferably about 1 to 2 hours, depending on the dimensions of the wood. Typically the reaction zone operates under superatmospheric pressure during the reaction. While high pressures can be undesirable from a process standpoint, the coloring reaction can be performed at the reaction pressure obtained during the process and is typically run at pressures less than about 200 p.s.i.g. At the end of the reaction, since the vessel is sealed and since an oxidizing gas may be consumed during the reaction, the vessel can have a negative pressure upon returning the temperature of the vessel to about the original ambient. The wooden member as it is withdrawn from the reaction chamber can be typically contacted with an aqueous stream to remove soluble and excess reaction mixture from the surface of the wood. The wooden member is then dried to a stable dimension. Typically, during the coloring chemical process, a layer is deposited on the surface of the wood that we call a "contamination layer". This layer must be removed in order to reveal the attractive, pleasing wood color. The layer can be removed with any convenient process step including chemical or mechanical removal means. A preferred removal means involves mechanically abrading the surface layer. Typically the wooden member can be abraded using common commercial abrading means such as sandpaper, metal abrasion means, sandblasting, high pressure air or water sprays, etc.

After the layer is removed the pleasing color is revealed. The surface of the wood if dry and dimensionally stable can be treated with commonly available sealants, preservatives, oils, clear finishes, etc. to preserve and protect the attractive appearance.

Further, since the wooden member is uniformly and totally colored, the wooden member can be planed, lathed, carved, molded, or otherwise mechanically treated in order to impart a new or different shape to the wooden member.

The invention can be further illustrated by reference to the following Example which contains a best mode.

EXAMPLE I

Into a 4-liter pressure reaction vessel equipped with a thermometer, pressure gauge and a pressure relief valve was placed 2000 milliliters of water and 80 grams of 85 wt-% calcium oxide. Into the calcium oxide slurry was placed a pine board, 19 mm×43 mm×411 mm, weighing 176.5 grams. The reaction apparatus was sealed, heated to a temperature of 160°–170° C. and reciprocally agitated over a 2-hour period. The reaction vessel was permitted to cool to ambient, the apparatus was opened, and the pine board was removed, washed to remove excess calcium carbonate and calcium hydroxide, and allowed to air dry. After drying at room temperature the board had a chalky-brown appearance due to a light deposit of a calcium compound. The board had lost 12% of its weight. Sanding the board yielded a rich brown, even, attractive color.

The pH of the reaction liquid was 11, insoluble solids in the liquid phase consisted of calcium carbonate and calcium hydroxide. The soluble calcium salts in the solution were identified to be salts of acetic acid, formic acid, glycolic acid, and lactic acid.

EXAMPLES II–XIX

Example I was repeated exactly except that the following conditions and observations, shown in Tables 1 and 2 for Examples II–XVI, occurred. The Tables show that a variety of woods can be successfully treated with the process and solutions of the invention.

TABLE 1

| Examples II–XVI | | | | | |
|---|---|---|---|---|---|
| Example | Wood | | Base | | Water |
| Number | Type | Wt. g | Type | Wt. g | ml |
| II | Pine, 2 boards | 160 each | CaO | 80 | 2000 |
| III | Pine, 2 boards | 179 & 180 | CaO | 80 | 2000 |
| IV | Pine, 2 boards | 321 & 335 | CaO | 80 | 2000 |
| V | Pine | 198 | CaO | 80 | 2000 |
| VI | Fir | 297 | CaO | 20 | 2000 |
| VII | Redwood, lt. sapwood | 239 | CaO | 40 | 2000 |
| VIII | Pine log | 1070 | CaO | 130 | 5570 |
| IX | Pine, 3 boards total wt. | 364 | CaO | 100 | 6000 |
| X | Pine | 174 | None | | 2000 |
| XI | Pine, 3 boards total wt. | 2791 | CaO | 363 | 3000 |
| XII | Pine | 302 | CaO | 39.5 | 6200 |
| XIII | Pine | 242 | Soln from XII | N/A | +375 |
| XIV | Pine | 310 | Ca Acetate | 40 | 6150 |
| XV | Pine | 246 | Ca Formate | 32 | 6250 |
| XVI | Pine | 754 | CaO | 190 | 4680 |

TABLE 2

| Examples II–XVI | | | | | |
|---|---|---|---|---|---|
| Example Number | Temp. °C. | Time at Temp. Min. | Press Max psig | Final Color Wood | Penetration of Color |
| II | 160 | 180 | 120 | Dk. br. | Total |
| III | 160 | 180 | 110 | Red br. | Total |
| IV | 160 | 180 | 110 | Dk. br. | Total |
| V | 140 | 180 | 70 | Dk. br. | Total |
| VI | 163 | 180 | 135 | Dk. br. | Total |
| VII | 140 | 210 | 70 | Dk. redwood | Total |
| VIII | 160 | 120 | 120 | Dp. gr. | Total |
| IX | 160 | 120 | 120 | Rich br. | Total |
| X | 115 | 180 | 35 | No change | |
| XI | 180 | 180 | 180 | Dp. br. | Total |
| XII | 160 | 120 | 110 | Brown | Total |
| XIII | 160 | 120 | 110 | Brown | Total |

TABLE 2-continued

| Examples II–XVI | | | | | |
|---|---|---|---|---|---|
| Example Number | Temp. °C. | Time at Temp. Min. | Press Max psig | Final Color Wood | Penetration of Color |
| XIV | 160 | 180 | 125 | Brown | Total |
| XV | 160 | 180 | 125 | Dk. br. | Total |
| XVI | 160 | 180 | 110 | Brown | Total |

The above specification and Example provide a clear explanation of the invention. However, since many embodiments of the invention can be made without departing from the spirit and scope of the invention, the invention resides in the claims hereinafter appended.

We claim:

1. A method for coloring soft wood so as to emphasize the natural grain of the soft wood, which comprises the steps of:

(a) immersing a soft wooden member in a liquid treating composition having a pH greater than about 7 and comprising at least an aqueous mixture from 1 to 25 weight percent of solution of an alkaline earth metal base; the wooden member immersed in the treating composition at an elevated temperature of about 120° to 200° C., and an elevated pressure of about 1 to 200 p.s.i.g. to result in a color forming reaction which darkens the wooden member across substantially the entire cross-section thereof so as to emphasize the natural grain of the wooden member; and (b) removing from the wooden member a sufficient amount of an alkaline earth based layer which has formed on the wooden member to reveal the attractive, decorative appearance of the soft wooden member.

2. The method of claim 1 wherein the wooden member is made of pine, fir, cedar, redwood, or spruce.

3. The method of claim 2 wherein the wooden member is green wood.

4. The method of claim 1 wherein at least two surfaces of the wooden member are immersed in the treating composition.

5. The method of claim 1 wherein the wooden member is a composite wooden structure.

6. The wooden member of claim 2 wherein the wood is dried and seasoned.

7. The method of claim 1 wherein the treating composition is present at a concentration of about 2 to 20 liters per kilogram of wood.

8. A soft wooden member having a darkened appearance which emphasizes the natural grain of the wooden member; the wooden member comprising the product of the process of:

(a) immersing a soft wooden member in a liquid treating composition having a pH greater than about 7 and comprising at least an aqueous mixture from 1 to 25 weight percent of solution of an alkaline earth metal base; the wooden member immersed in the treating composition at an elevated temperature of about 120° to 200° C., and an elevated pressure of about 1 to 200 p.s.i.g. to result in a color forming reaction which darkens the wooden member across substantially the entire cross-section thereof so as to emphasize the natural grain of the wooden member; and (b) removing from the wooden member a sufficient amount of an alkaline earth based layer which has formed on the wooden member to reveal the attractive, decorative appearance in the soft wooden member.

9. The member of claim 8 wherein the wooden member is made of pine, fir, cedar, redwood, or spruce.

10. The member of claim 9 wherein the wooden member is green wood.

11. The member of claim 8 wherein at least two surfaces of the wooden member is immersed in the treating composition.

12. The member of claim 8 wherein the wooden member is a composite wooden structure.

13. The member of claim 9 wherein the wood is dried and seasoned.

14. The member of claim 8 wherein the treating composition is present at a concentration of about 2 to 20 liters per kilogram of wood.

15. A method for the coloration of soft wood to emphasize the natural grain of the soft wood which comprises the steps of:

(a) forming a treating composition containing about 1 to 20% by weight of calcium oxide, calcium hydroxide or mixtures thereof in water at a pH of greater than about 7;

(b) immersing a soft wooden member in the treating composition of (a) at a ratio of about 2 to 20 liters of the solution per each kilogram of the soft wooden member at a temperature of greater than about 140° C. up to about 200° C. in an enclosed pressure vessel at a superatmospheric pressure less than about 200 p.s.i.g. to result in a color forming reaction which results in a darkening of the wooden member across substantially the cross-section thereof so as to emphasize the natural grain of the wooden member; and (c) removing from the wooden member a sufficient amount of an alkaline earth based layer which has formed on the wooden member to reveal the attractive, decorative appearance in the soft wooden member.

16. The method of claim 15 wherein the wood is pine, fir, cedar, redwood, or spruce.

17. The method of claim 16 wherein the wood is dried and seasoned.

18. The method of claim 16 wherein the wooden member is a composite wooden structure.

19. The method of claim 18 wherein the composite wooden structure is a plywood.

20. The method of claim 15 wherein the wooden member is green wood.

21. The method of claim 15 wherein at least two surfaces of the wooden member are contacted with the treating composition.

22. A soft wooden member having a darkened appearance which emphasizes the natural grain of the wooden member; the wooden member comprising the product of the method which comprises the steps of:

(a) forming a treating composition containing about 1 to 20% by weight of calcium oxide, calcium hydroxide or mixtures thereof in water at a pH of greater than about 7;

(b) immersing a soft wooden member in the treating composition of (a) at a ratio of about 2 to 20 liters of the solution per each kilogram of the soft wooden member at a temperature of greater than about 140° C. up to about 200° C. in an enclosed pressure vessel at a superatmospheric pressure less than about 200 p.s.i.g. to result in a color forming reaction which results in a darkening of the wooden member across substantially the cross-section thereof so as to emphasize the natural grain of the wooden member; and (c) removing from the wooden member a sufficient amount of an alkaline earth based layer which has formed on the wooden member to reveal the attractive, decorative appearance in the soft wooden member.

23. The member of claim 22 wherein the wood is pine, fir, cedar, redwood, or spruce.

24. The member of claim 23 wherein the wood is dried and seasoned.

25. The member of claim 23 wherein the wood is green.

* * * * *